United States Patent [19]

Schmoll, III

[11] 4,175,465

[45] Nov. 27, 1979

[54] CIRCUIT FOR SIMULATING STRING BASS SOUND

[75] Inventor: George F. Schmoll, III, Dolton, Ill.

[73] Assignee: CBS Inc., New York, N.Y.

[21] Appl. No.: 901,950

[22] Filed: May 1, 1978

[51] Int. Cl.[2] ..... G10H 1/06; G10H 5/12

[52] U.S. Cl. ..... 84/1.26; 84/1.13; 84/1.23; 307/230; 328/167

[58] Field of Search ..... 84/1.13, 1.23, 1.26, 84/DIG. 9, DIG. 10; 179/1 A, 1 D; 307/229, 230; 328/167; 333/70 R, 70 CR

[56] References Cited

U.S. PATENT DOCUMENTS

| | | | |
|---|---|---|---|
| 3,636,801 | 1/1972 | Ichikawa | 84/1.13 |
| 3,715,445 | 2/1973 | Kniepkamp | 84/1.13 |
| 3,723,633 | 3/1973 | Adachi | 84/1.26 X |
| 3,930,429 | 1/1976 | Hill | 84/1.26 X |
| 3,935,783 | 2/1976 | Machanian | 84/1.13 X |

*Primary Examiner*—Stanley J. Witkowski
*Attorney, Agent, or Firm*—Spencer E. Olson

[57] ABSTRACT

In a circuit for simulating the sound produced when a stringed instrument, such as a bass viol, is plucked, square wave signals of different frequencies from a tone generator are combined to produce a synthesized saw-tooth waveform which is applied to a low pass filter to remove the extremely high order harmonics, and then applied to an amplifier the gain of which is controlled in accordance with an envelope signal having a fast attack and a relatively slow decay. The resulting amplified signal is applied to an off-center-biased amplifier which alters the harmonic content of the output signal as a function of decay time such that when the signal is acoustically reproduced it closely simulates the sound produced when a bass viol string is plucked.

6 Claims, 1 Drawing Figure

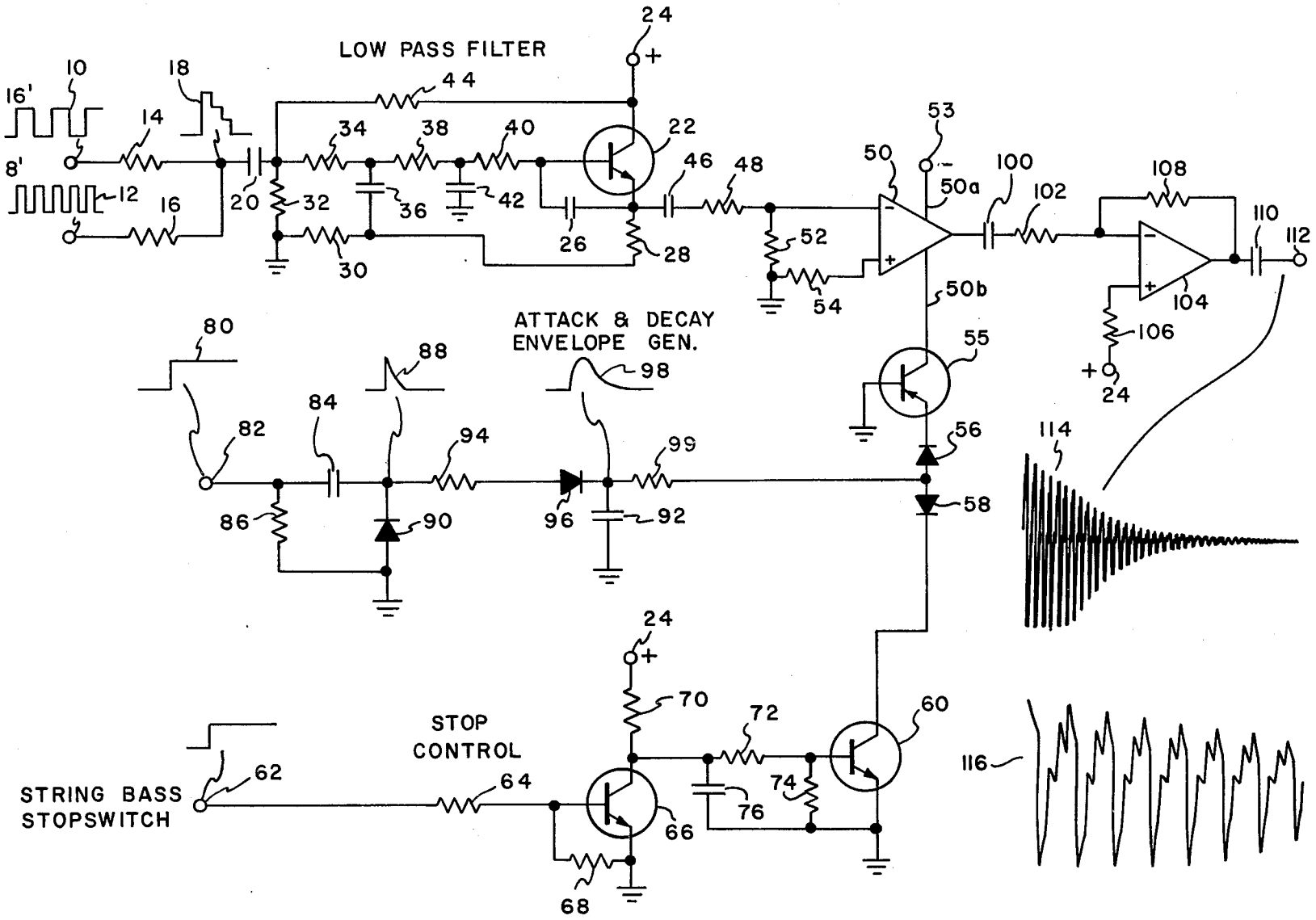
LOW PASS FILTER
ATTACK & DECAY ENVELOPE GEN.
STOP CONTROL
STRING BASS STOPSWITCH

CIRCUIT FOR SIMULATING STRING BASS SOUND

BACKGROUND OF THE INVENTION

This invention relates to electronic musical instruments, and, more particularly, to an electronic circuit for use in an electronic organ for simulating a string bass sound.

The timbre or tonal qualities of the sounds generated by an electronic organ are conventionally achieved by producing an audio frequency signal of the particular wave shape which when reproduced by a loudspeaker produces the desired tonal quality, one common system being characterized as of the "formant" type which starts with a pulse wave shape, for example a rectangular pulse or sawtooth pulse, and uses various filters to attenuate or emphasize desired harmonic frequencies to achieve an audio frequency signal of desired wave shape. U.S. Pat. No. 3,316,341, for example, describes the use of a dynamic filter, a tuned resonant filter that peaks certain frequencies in the audio frequency spectrum and attentuates others, both above and below the frequency to which the filter is tuned, for introducing dynamic variations, under player control, in the tone quality of an electrical musical instrument. Many other specific combinations of starting wave shape and filters of different characteristics are known for producing particular sounds, but applicant is unaware of any system for economically electrically producing a wave shape which when reproduced by a loudspeaker produces a sound simulative of a plucked string bass sound. Analysis has revealed that the sound signal immediately following plucking contains many high order harmonics and thereafter the sound dies away with a relatively long time constant toward a substantially pure fundamental sound, having few or any significant harmonics.

It is a primary object of the present invention to provide an electronic circuit for economically producing an electrical signal which when reproduced simulates the sound of a plucked string bass.

SUMMARY OF THE INVENTION

Briefly, the object of the invention is achieved in a system including a source of square wave signals having fundamental frequencies corresponding to the notes of a musical scale by appropriately combining square wave pulses by the known "stair-stepping" technique to produce a signal musically equivalent to a sawtooth waveform, which contains both even and odd harmonics. This signal is filtered to smooth out the "steps" and to remove the extremely high order harmonics, and is then applied to an amplifier the gain of which is controlled in accordance with an attack and decay envelope having a sharp rise time, and an initial fast decay followed by a relatively slow decay. The amplified signal is applied to an extremely high gain amplifier that is biased slightly off-center. The amplitude of the applied signal is sufficient that it is initially clipped at the output, with clipping occurring for different periods of time as the output signal decays. As a result, the output signal is initially very rich in both odd and even harmonics, and as the clipping is removed from one side of the signal the odd harmonics are greatly reduced causing the number and nature of the harmonics in the output signal to change as a function of time. When clipping no longer occurs, the signal decays into a wave essentially sawtooth in shape having essentially only even harmonics, only a few of the low order ones of which are of any consequence. The resulting signal is highly simulative of that produced when a string on a bass guitar or on an acoustic string bass is plucked.

BRIEF DESCRIPTION OF THE DRAWINGS

Other objects, features and advantages of the invention will become apparent, and its construction and operation better understood, from the following detailed description taken in conjunction with the accompanying drawing, the single FIGURE of which is a schematic diagram of a circuit for simulating a string bass sound.

DETAILED DESCRIPTION OF THE INVENTION

The system according to the invention utilizes as a primary source of tone signals a tone-generating system for producing signals of square wave form having fundamental frequencies corresponding to the notes of a musical scale. These square wave signals are initially converted into a pulse signal having a waveform which contains both even and odd harmonics. In particular, in the illustrated embodiment a sixteen foot square wave signal 10 and an eight foot square wave signal 12, phase-locked with signal 10, are summed in the known two-to-one ratio in a resistor network consisting of resistors 14 and 16 to produce the "stair-stepped" signal 18. This signal is coupled through a capacitor 20 to a low pass filter for smoothing out the waveform and for removing the extremely high order harmonics. The illustrated filter, suitable for this purpose, is a two-stage active RC filter including a transistor 22 the collector electrode of which is connected to a source of positive potential represented by terminal 24, and the emitter electrode of which is connected through a capacitor 26 to the base electrode and through resistors 28 and 30 to ground potential. The first stage consists of resistors 30, 32 and 34 and a capacitor 36, and the second stage includes resistors 38 and 40 connected in series with resistor 34 and to the base electrode of the transistor, and a capacitor 42 connected between the junction of resistors 38 and 40 and ground. A feedback resistor 44 is connected between the collector electrode of the transistor and the junction of resistors 32 and 34. The filtered generally sawtooth signal developed across resistor 28 is coupled by a capacitor 46 and a resistor 48 in series therewith to the inverting input of an operational transconductance amplifier 50, which may be an RCA CA3080 OTA, for example. The inverting and non-inverting inputs of amplifier 50 are connected to ground via resistors 52 and 54, respectively. The negative supply terminal **50*a* of the amplifier is connected to a source of negative potential represented by terminal 53, typically having a value of −15 volts, and its control terminal 50*b*, the current at which controls the gain of the amplifier, is connected through a transistor 55, diodes 56 and 58 and a transistor 60, the emitter electrode of which is connected to ground. The current flow in this circuit controls the gain of amplifier 50** from essentially zero, when the string bass stop switch is "off", to a predetermined gain factor when the string bass stop switch is "on" and circuit operation is initiated either by depressing a pedal of the electronic organ in which the circuit is incorporated or by suitable pulses from an automatic rhythm pattern generator.

A terminal 62 connected to the string bass stopswitch is normally at zero potential but goes positive when the stopswitch is turned "on". This positive potential is applied through a resistor 64 to the base electrode of a transistor 66, the emitter electrode of which is connected to ground and also through a resistor 68 to the base, and the collector electrode of which is connected through a resistor 70 to positive potential source 24. The resulting reduction of the potential at the collector of transistor 66 to approximately zero volts, applied to the base electrode of transistor 60 through a network comprising resistors 72 and 74, turns previously conducting transistor 60 off, thereby taking diode 58 out of the circuit and allowing the now to be described attack and decay envelope generator to control the gain-determining current at terminal **50*b* of amplifier 50**.

More particularly, when a pedal of the organ is depressed, a steady state DC signal 80 is applied to terminal 82 and differentiated by a circuit comprising a capacitor 84 and a resistor 86 to produce a sharp positive-going pulse 88; a diode 90 connected across the series connected resistor 86 and capacitor 84 prevents the production of negative-going pulses. This pulse charges a capacitor 92 through a resistor 94 and a diode 96, the resistor 94 and capacitor 92 having such values as to produce a DC envelope 98 having a steep rise time and a relatively long decay time. Typically, the rise time of the envelope 98 is in the order of milliseconds and may be in the range from at least one to as much as thirteen or fourteen milliseconds. The decay starts fast and then decays slowly so that the duration of the entire envelope is of the order of five to eight seconds, generally corresponding to the time the string of a string bass vibrates before it dies away. It is to be understood that because different musicians play a given string bass differently, with the consequence that the specific harmonic structure of the sound may differ from musician to musician, there can be some variation in the attack and decay times of the envelope 98 and yet obtain a simulation representative of the average of the sound produced by several string bass musicians. The DC envelope signal 98 is applied through a resistor 99, diode 56 and transistor 55 to the control terminal **50*b* of amplifier 50, the transistor 55 functioning as a current source to control the current at control terminal 50*b*, and thus the gain of the operational transconductance amplifer, in accordance with envelope signal 98 which, in turn, determines the envelope of the amplified sawtooth signals appearing at the output terminal of amplifier 50**.

The output signal from amplifier 50, a series of generally sawtooth shaped pulses of a frequency within the range of 60 Hz to 240 Hz (depending on the frequencies of square wave signals 10 and 12), the amplitude of which varies in accordance with envelope 98, is applied through a capacitor 100 and a resistor 102 to the inverting input of an operational amplifier 104. The non-inverting input of the amplifier is connected through a resistor 106 to positive potential source 24, and the output terminal is connected through a feedback resistor 108 to the inverting input. The gain of the amplifier, which may be of the "Norton" type, and consisting of one section of an LM 3900 integrated circuit chip, is determined by the ratio of the resistances of resistors 102 and 108; in a satisfactorily operated embodiment of the invention the gain was 2200. The amplifier 104 is biased slightly off-center so that in the initial portion of audio envelope 98 the amplitude of the sawtooth pulses from amplifier 50 is sufficiently high as to be clipped at the output of amplifier 104, and because of the off-center bias there continues to be clipping at one extremity of the waveform excursions for a longer period than at the other extremity, as the waveform decays. That is, because the input signal is a train of inverted filtered sawtooth shaped pulses, the peaks in the output signal will have a greater amplitude on one side than the other so that during the decay period the larger amplitude pulses will continue to be clipped beyond the time when the lower amplitude pulses on the other side are no longer clipped. This effect is graphically illustrated by the reproduction at 114 of an oscillogram of the signal produced at the output terminal of amplifier 104, and the spread out oscillogram of the first eight cycles of waveform 114 shown at 116. It will be observed that in waveform 114 the positive-going excursions are not clipped but decay gradually in amplitude in accordance with envelope 98, whereas the first five or six negative-going excursions are clipped and thereafter decay in amplitude at a different rate than do the corresponding positive-going excursions. Waveform 116 illustrates that initially the signal is very rich in harmonics, and that as the signal decays and the positive-going excursions are no longer clipped, the odd harmonics are reduced. After the waveform reaches the point where there is no longer clipping on either the positive- or negative-going excursions, it essentially decays into a wave of essentially the same shape as that developed across resistor 28, namely, a rounded sawtooth wave rich in even harmonics of which only a few of the lower order ones are of any significance. The output signal from amplifier 104 is coupled through a capacitor 110 to an output terminal 112 which, in turn, may be connected to an output amplifier and loudspeaker (not shown) for acoustical reproduction.

While the invention has been particularly shown and described with reference to a preferred embodiment thereof, it will be understood by those skilled in the art that various modifications in form and detail may be made therein without departing from the spirit and scope of the invention as set forth in the appended claims.

I claim:

1. In an electronic organ including tone generating means for producing a plurality of square wave signals having octavely related frequencies, apparatus for generating an electrical signal which when acoustically reproduced simulates a string bass sound, said apparatus comprising:

first circuit means for producing from said square wave signals pulses having a substantially sawtooth waveform and a preselected repetition frequency, first amplifier means connected to receive said pulses for controlling the amplification of said pulses in accordance with an envelope signal having a short attack time and a relatively long decay time, and second amplifier means connected to receive amplified pulses from said first amplifier means for altering the harmonic content of the pulses produced at its output as a function of the attack and decay times of said envelope signal and producing an output electrical signal which when acoustically reproduced simulates a string bass sound.

2. Apparatus according to claim 1, wherein said first circuit means comprises means for combining in predetermined amplitude proportions at least two of said square wave signals from the tone generating means to synthesize pulses having a generally sawtooth waveform, and low pass filter means connected to receive said synthesized pulses for removing therefrom high order harmonics.

3. Apparatus according to claim 1 or claim 2, wherein said electronic organ further includes operator-controllable means for producing an enabling signal for initiating production of said string bass simulating signal, and wherein said apparatus further includes means responsive to said enabling signal for generating said envelope signal for controlling the amplification of said first amplifier means.

4. Apparatus according to claim 3, wherein said first amplifier means is an operational transconductance amplifier the amplification of which is controlled by current applied to a control terminal thereof, and further including a current source controllable by said envelope signal generating means for controlling the current applied to said control terminal in accordance with said envelope signal.

5. Apparatus according to claim 1 or claim 2, wherein said electronic organ further includes operator-controllable means which when activated to initiate generation of said string bass simulating signal produces an enabling signal, wherein said apparatus further includes means responsive to said enabling signal for generating said envelope signal, and wherein said second amplifier means is an off-center-biased high gain operational amplifier for clipping the positive-going excursions of the output sawtooth pulses differently than the negative-going excursions thereof and for causing the positive-going excursions to decay at a different rate than the negative-going excursions, thereby to alter the harmonic content of the output pulses as a function of time.

6. Apparatus according to claim 5, wherein said first amplifier means is an operational transconductance amplifier and amplification of which is controlled by current applied to a control terminal thereof, and further including a current source controllable by said envelope signal for controlling the current applied to said control terminal in accordance with said envelope signal.

* * * * *